US011878859B2

(12) United States Patent
Eisold

(10) Patent No.: US 11,878,859 B2
(45) Date of Patent: Jan. 23, 2024

(54) SIDE WING OPENING CONTAINER

(71) Applicant: Cakeboxx Technologies, LLC, McLean, VA (US)

(72) Inventor: Daine Edward Eisold, McLean, VA (US)

(73) Assignee: CAKEBOXX TECHNOLOGIES, LLC, McLean, VA (US)

( * ) Notice: Subject to any disclaimer, the term of this patent is extended or adjusted under 35 U.S.C. 154(b) by 0 days.

(21) Appl. No.: 17/879,500

(22) Filed: Aug. 2, 2022

(65) Prior Publication Data

US 2023/0202750 A1 Jun. 29, 2023

Related U.S. Application Data

(60) Provisional application No. 63/228,593, filed on Aug. 2, 2021.

(51) Int. Cl.
*B65D 88/58* (2006.01)

(52) U.S. Cl.
CPC ..... *B65D 88/58* (2013.01)

(58) Field of Classification Search
CPC ..... B65D 90/0086; B65D 90/0062; B65D 88/58; B65D 88/126; B65D 43/16; B65D 90/582; B65D 90/623; B60J 5/0498; B65F 2001/165; B65F 1/1646
USPC ..... 220/1.5
See application file for complete search history.

(56) References Cited

U.S. PATENT DOCUMENTS

2012/0024851 A1* 2/2012 Strasser, Sr. ..... B60J 5/0498 220/211
2013/0036673 A1* 2/2013 Wassenaar ..... B65D 90/66 220/1.5
2022/0250833 A1* 8/2022 Nguyen ..... B65D 90/0066

FOREIGN PATENT DOCUMENTS

EP 1876115 A2 * 1/2008 ..... B65D 88/126
GB 1206689 * 10/1968 ..... B65D 43/16

* cited by examiner

*Primary Examiner* — Anthony D Stashick
*Assistant Examiner* — Raven Collins
(74) *Attorney, Agent, or Firm* — Cermak Nakajima & McGowan LLP; James Creighton Wray

(57) ABSTRACT

A side opening intermodal shipping container has a fixed base, end walls, back wall and part of a roof. A movable entire side wall is connected to a movable partial roof. The movable partial roof is hinged to the fixed roof part. Hydraulic cylinders rotate the movable side wall and roof part, opening an entire side and a portion of the top within a limited clearance space. A large object may be loaded into the container and removed from the container indoors.

6 Claims, 8 Drawing Sheets

SIDE WING OPENING CONTAINER

The new side wing opening intermodal shipping containers solve problems of loading and unloading products having unusual dimensions and problems of loading and unloading products through container sides.

Some locations have forklift trucks of limited size. The present invention solves the problem with self-contained structures and mechanisms for self-opening of an entire side of a covered container. Pressing buttons lifts an unlocked side ready for rapid loading or unloading an intermodal shipping container from a completely opened side.

Pressing buttons self-closes the side to tightly seal the container. The movable side is locked with twist locks in the base.

The new invention solves problems of quickly loading and unloading intermodal shipping containers for carrying large and heavy objects.

The new side wing opening containers solves problems of transporting airplane wings from manufacturing plants to aircraft assembly plants. Airplane wings are fully enclosed in new intermodal shipping containers and are anchored in the new unique container.

The aircraft wings are inserted through open sides of the containers at the manufacturing plants. The wings are anchored in the containers, using the strong wing connections that later connect the wings to the strong wing boxes in the aircraft.

The container bases are created to hold strong anchors and are configured to accept loads with unusual dimensions such as aircraft wings.

The opening and closing of the tight rigid side loading containers and their loading and unloading may be done indoors with limited roof heights.

SUMMARY OF THE INVENTION

An intermodal container has a base, and front and rear end walls extending upward from the base. A fixed side wall extends upward from the base, and opposite ends of the fixed side wall are connected respectively to vertical edges of the end walls.

A top has a fixed portion and a movable portion. The fixed portion of the top is connected to a top of the fixed side wall and to tops of the end wall. A movable portion of the top is hinged to an edge of the fixed portion of the top. A movable side wall is connected to the movable portion of the top. The movable side wall adjoins free edges of the end walls and an elongated upper edge of the base. Complementary fasteners are connected to the elongated upper edge of the base and to the lower edge of the movable side wall.

Middle posts are connected to ends of the base and to front and rear walls. Top corner plates are connected to corners of the movable portion of the top and the movable side wall. Hydraulic rams are connected to the corner plates and to the tops of the middle posts for raising and lowering the movable portion of the top wall and the movable side wall.

The intermodal shipping container has a closed-side and an openable side. A base has bottom side rails and bottom end rails connected to ends of the bottom side rails. Corner plates are connected to the bottom side rails and the bottom side rails at their intersections. Floor cross members are connected between the bottom side rails. Fixed end posts extend upward from connections with the corner plates. Top end rails are connected to the fixed end posts. A top closed-side rail connected to the top end rails. A middle top rail extends between the top end rails.

Frames are connected to the corner posts, the end rails, the bottom side rail on the closed side, the top end rails, the top middle rail and the top closed-side rail. End walls, a closed-side wall and a fixed roof portion are connected to the frames, the end rails, the closed side rails and the top middle rail.

A movable sidewall has a movable roof portion and a movable side wall portion. The movable roof portion has roof portion cross members hinged to the top middle rail. The movable side portion has a top side rail, a bottom rail and side edge supports connected to the top side rail and to the bottom rail. Spaced support members connected to the movable side portion parallel to the side edge supports are spaced equally with the movable roof section cross members and are connected thereto. Angular truss forming members connected to the spaced support members and to the movable roof section cross members reinforce and stabilize the movable side wall.

Spaced parallel vertical side supports on the closed-side wall extend from the base bottom side rail to the top closed-side rail. The vertical side supports are spaced with and connected to fixed roof portion cross members. Diagonal rigid members between connections with intersections of the spaced parallel vertical side supports with the bottom side rail to the middle top rail at the fixed roof portion cross members, forming trusses and supporting the middle top rail, the closed-side wall and the fixed roof portion.

Middle posts are connected to the bottom end rails. Hydraulic rams are connected to intersections of the movable top side edges and to tops of the middle posts for raising and lowering the movable side wall and the movable roof portion.

V-shaped truss support structures extending downward from sides of a raised movable side for holding the movable side and roof portion upwards when the movable sidewall is in raised position.

Movable blocks connect to end wall frame structures for moving to block and support the V-shaped truss support structures when the movable sidewall is in raised position.

DETAILED DESCRIPTION

Figure 1:
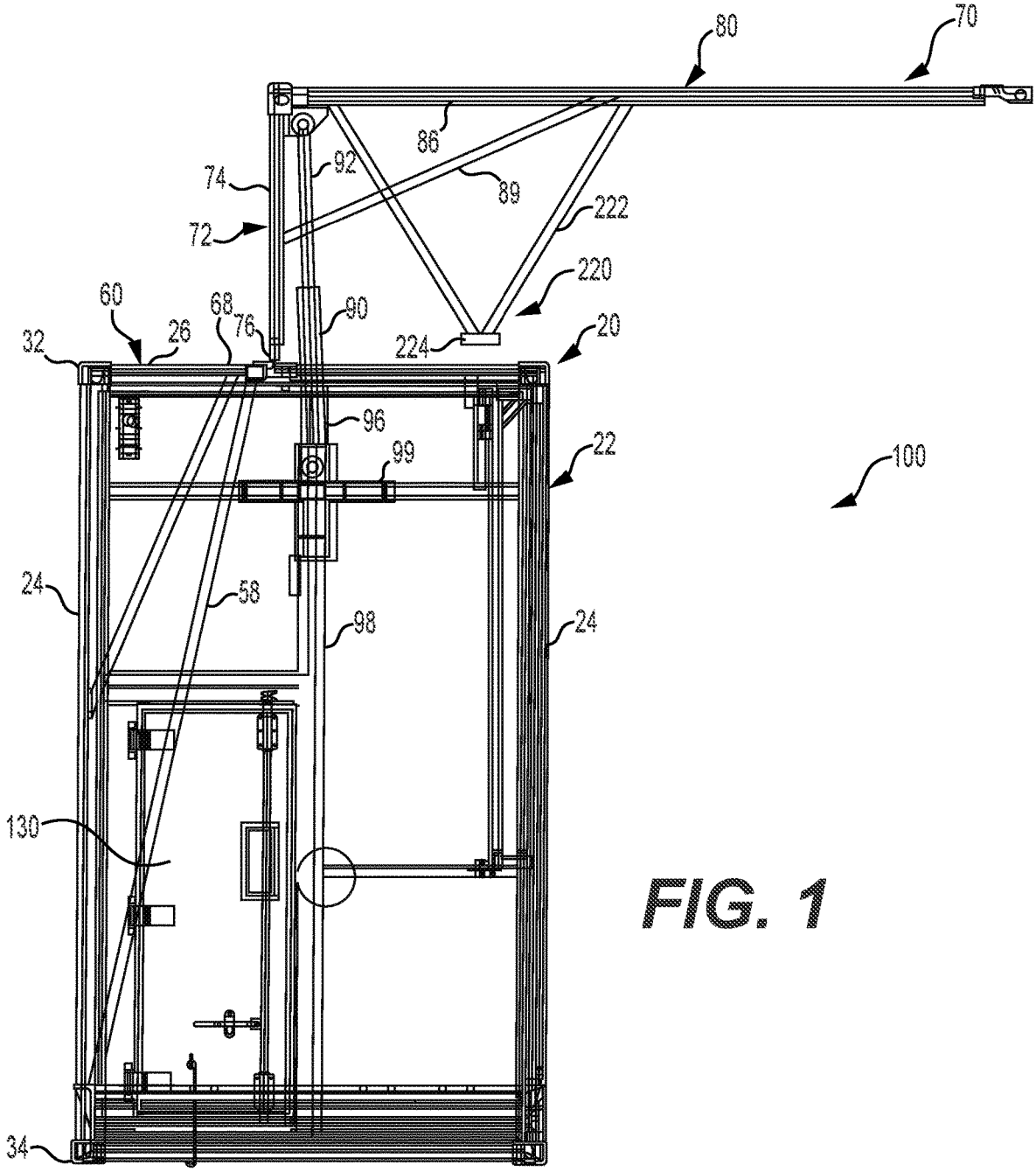
FIG. 1 is a view of the internal structure of an open wing side opening container taken from a front end.

One example is a 48' (L)×8' (W)×13"6" (H) of then wing side opening container. The container is made of weather resistant steel frame and cross members and stainless steel, or aluminum wall panels and roof panel.

One movable side has an aluminum side panel. Hardwood floor filler is used. Polypropylene-FRP side, door, roof lining, and subfloor complete the example. Frames are made from folded and welded sections of high tensile weather resistant steel (Corten A) welded to the upper and lower corner plates.

Top side rails are made of steel rectangular tubing. Bottom side rails are made of high tensile C channel.

The floor cross members are made of weather resistant steel and welded to the bottom side rails. Three sets of forklift pockets are welded to the bottom side rails.

In some embodiments the floor is embossed sheet metal welded together to form one panel by automatic welding. Polypropylene-FRP subfloor and wall and roof insulation of 58 mm polyurethane foam are provided in insulated movable and fixed side walls.

One embodiment of the side wing opening container is shown in FIGS. 1-13.

The side wing opening intermodal shipping container 100 has a frame 20 with end frames 22 made of folded and welded sections of high strength high tensile weather resistant Corten steel vertical posts 24 and steel rectangular tubing cross rails 26 welded to upper corner plates 32 and lower corner plates 34.

Figure 3:
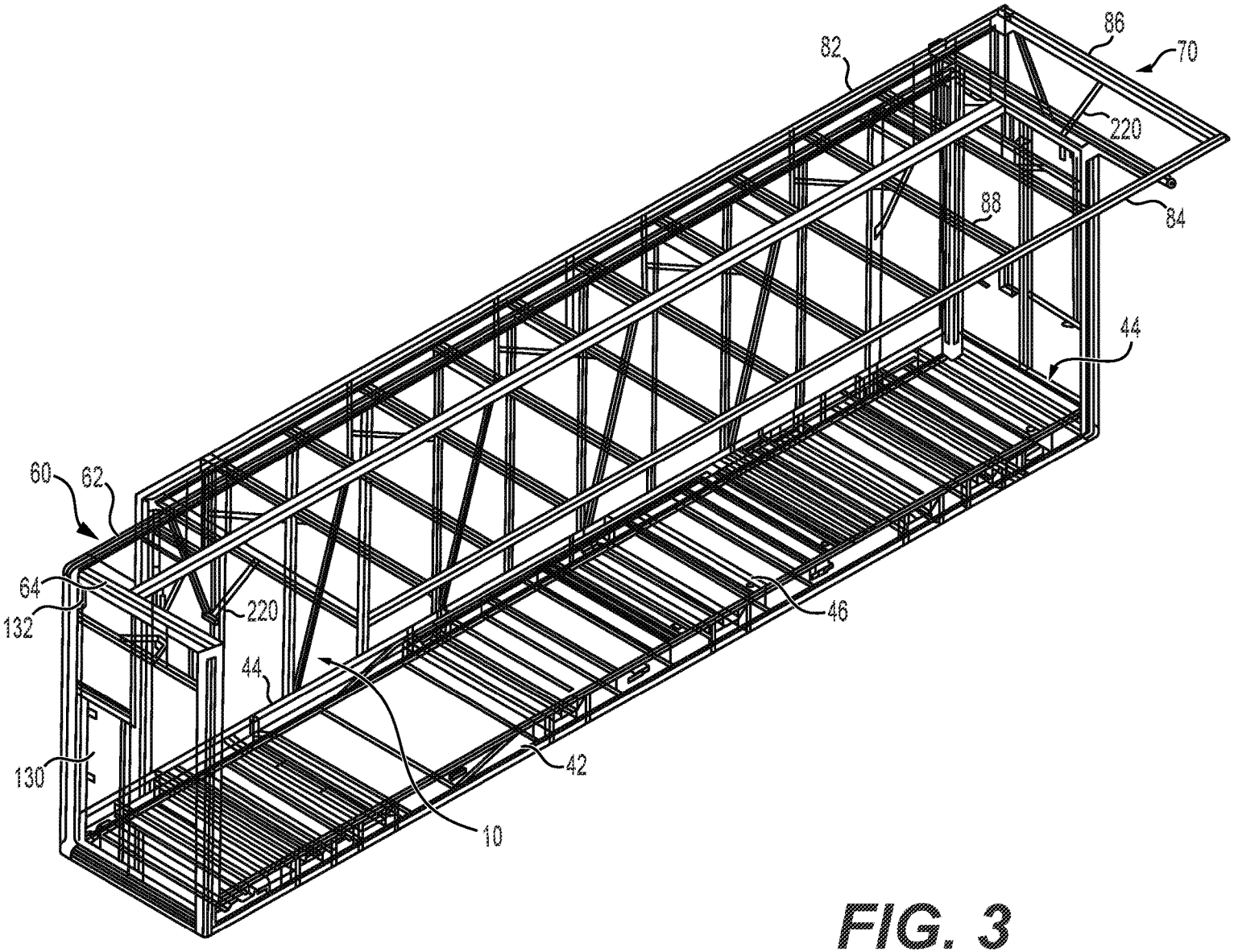
FIG. 3 is a perspective left side, top and front-end skeleton view of the side wing container with the movable left side open for loading and unloading of cargo.
Figure 4:
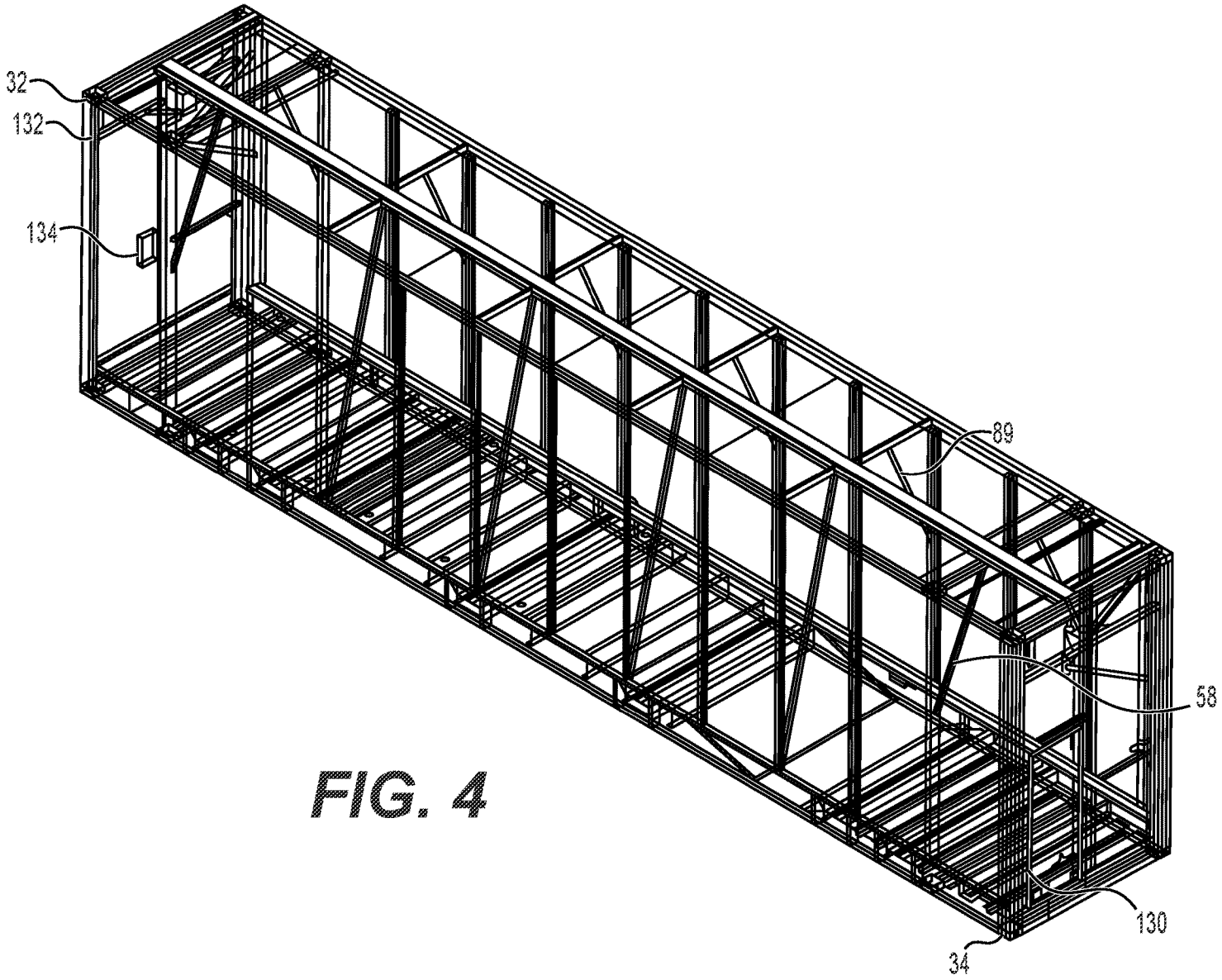
FIG. 4 is a top, front end, and fixed right side perspective view of the aircraft wing container taken from a rear end.

Bottom side rails 42 and 44 shown in FIG. 3 are made of high tensile C channels. Bottom cross member floor supports 46, made of weather resistant steel, are welded to the bottom rails 42.

Fixed right-side end posts 52 and end middle posts 53 are welded to the bottom side rails 42 and to the roof side, ends and middle rails of the fixed roof 60.

The fixed roof 60 side rail 62, end rails 64 and middle rails 63 are made of steel rectangular tube. Trusses 10 to support the fixed roof 60 and the wing side wall 70 are formed by the vertical members 58, the sloping members 59 and the roof cross members 68.

The wing side wall 70 has a roof portion 72 and a side wall portion 80. The roof portion has cross members 74 hinged at ends 76 to the fixed roof middle rail 63.

The sidewall portion 80 has rectangular tubes as a top side rail 82, a bottom rail 84 and side edge strong rectangular tubes 86. Side support tubes 88 are welded to the top side rail 82 and to the bottom rail 84.

Angular support tubes 89 are connected between the roof crossmembers 74 and the side support tubes for providing a truss to keep the sidewall portion 80 flat.

Figure 2:
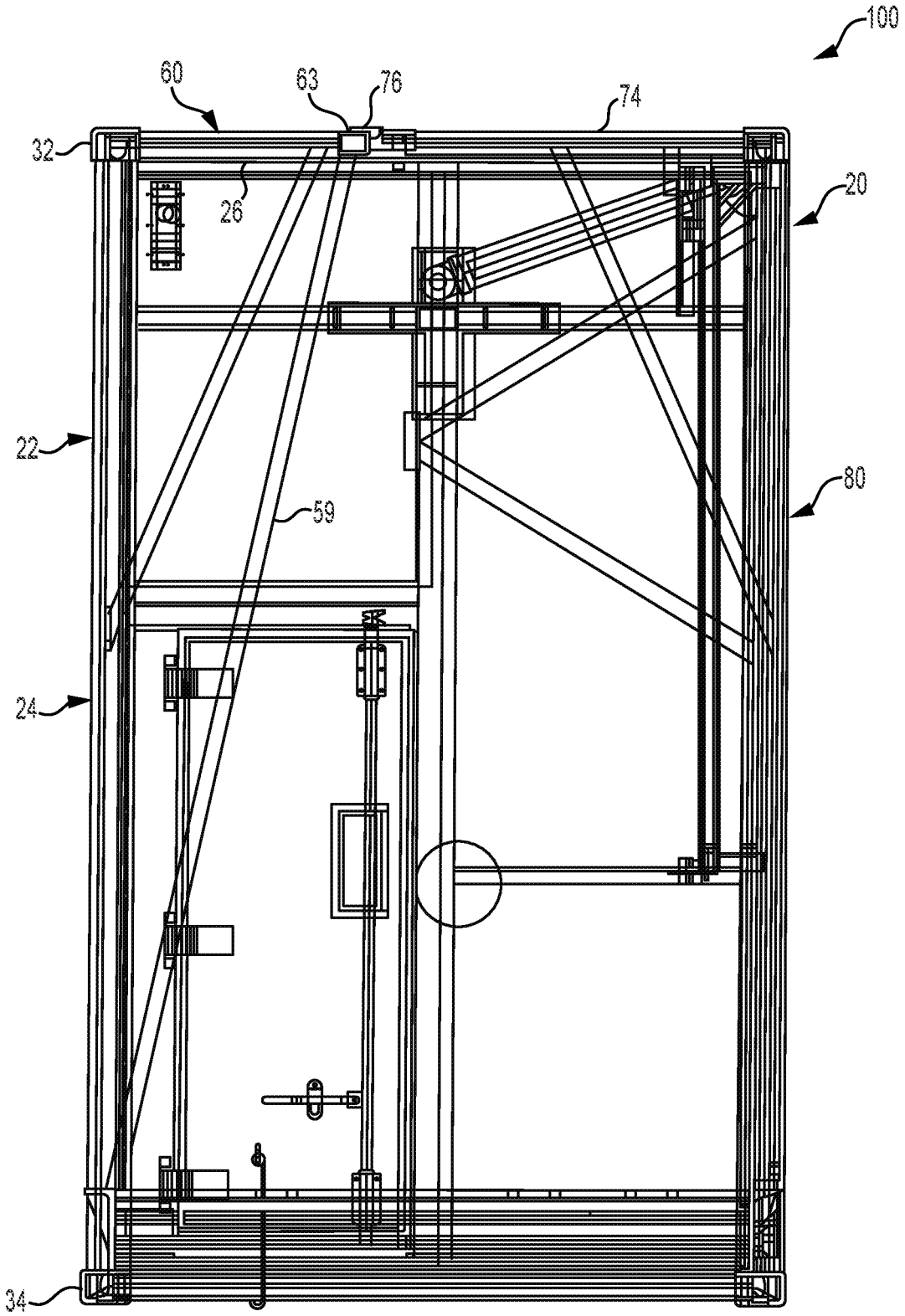
FIG. 2 is an internal skeleton view with the side opening closed taken from the front end.

The wing side wall is raised and lowered by hydraulic rams 90 as shown in FIGS. 1 and 2.

Piston ends 92 of the hydraulic rams 90 are connected to the wing side wall 70 With corner plates 94 connected between the sidewall portion 80 and the roof portion.

Cylinders 96 of the rams 90 are connected to middle posts 98 in the front and rear ends and are stabilized by cross member 99 extending between posts 24 of the end frames 22, as shown in FIGS. 1 and 2.

Figure 6:
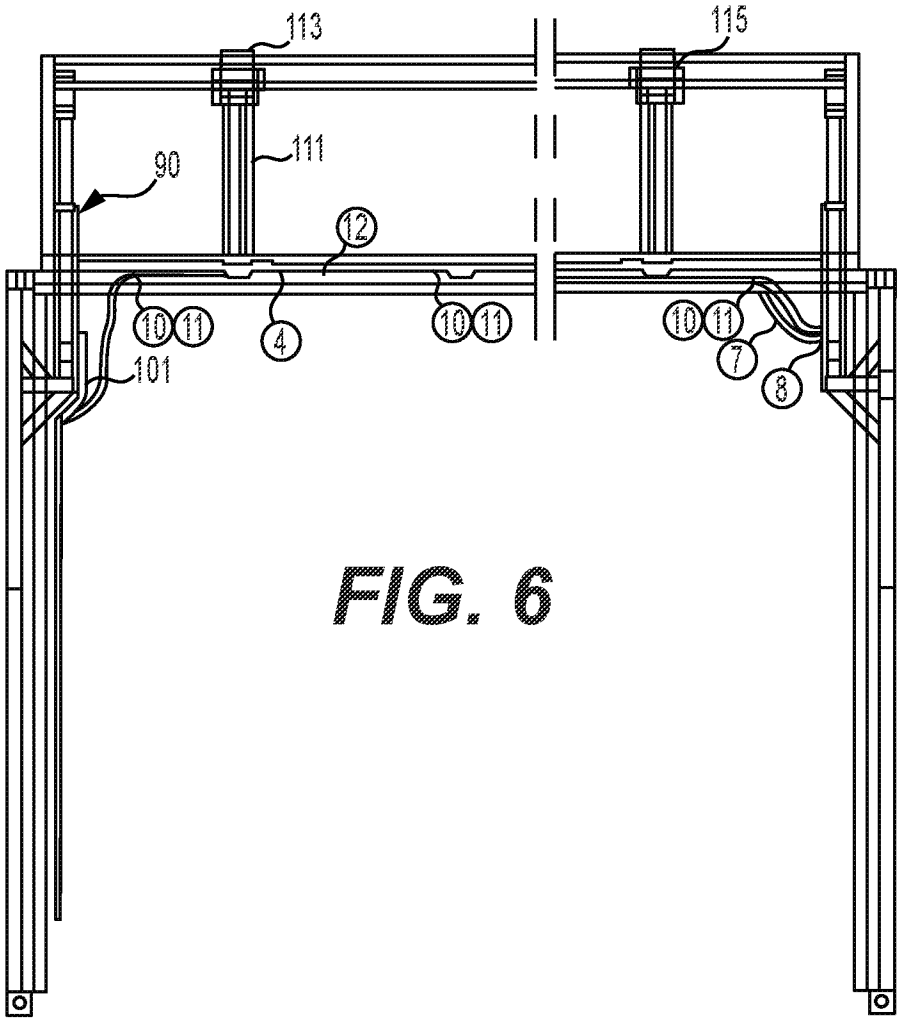
FIG. 6 is a foreshortened side elevation of the side opening and raising structure.
Figure 5:
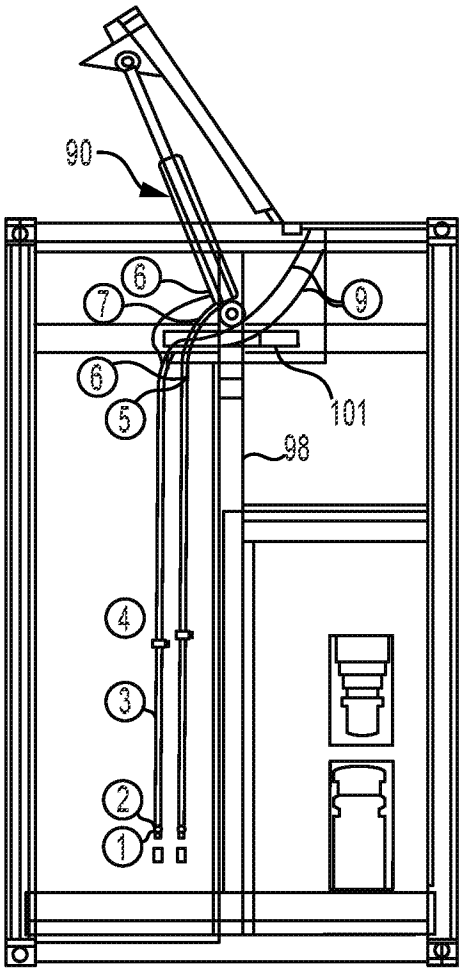
FIG. 5 is a partial rear elevation detail showing a side raising structure.
Figure 7:
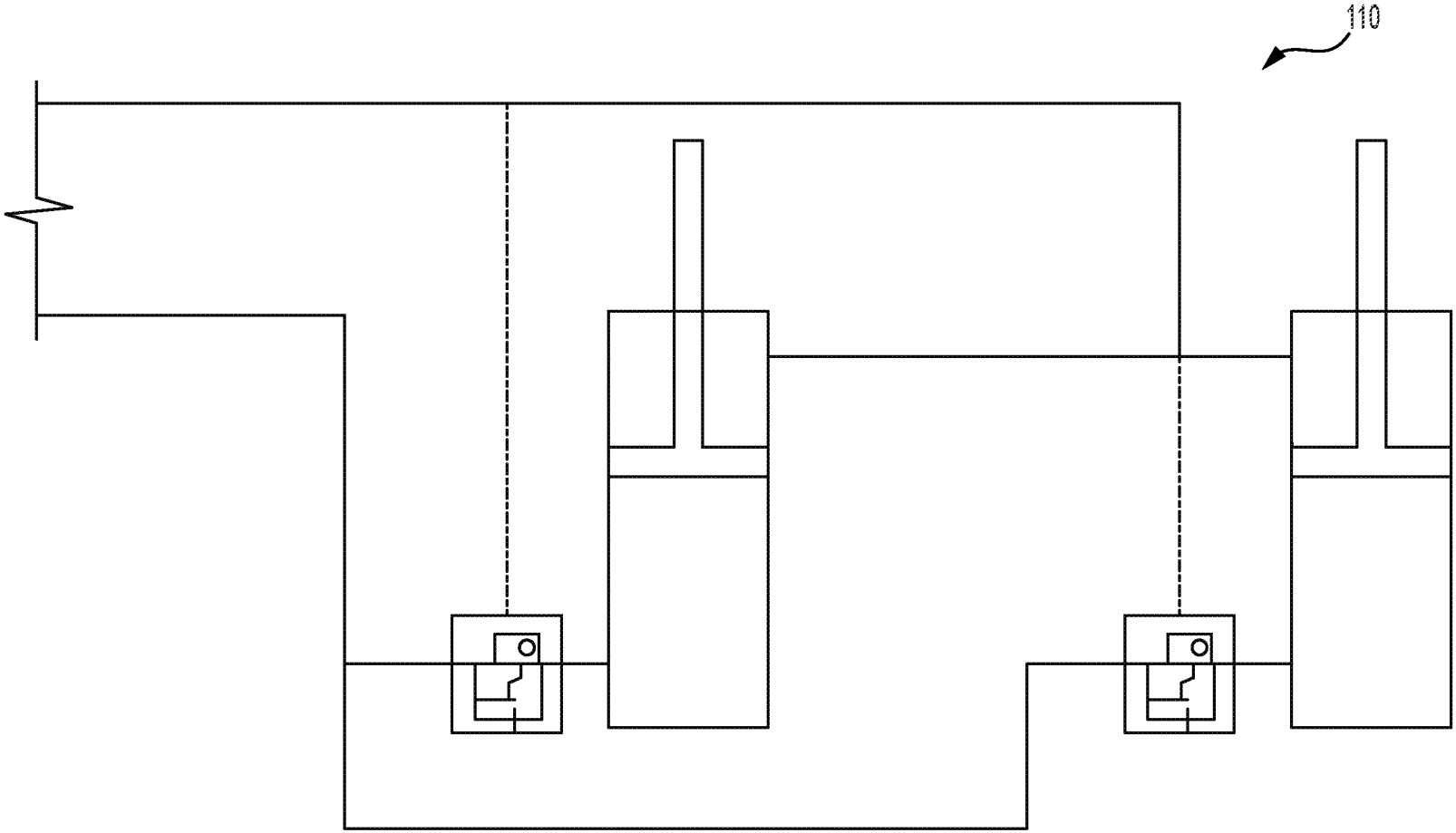
FIG. 7 is a hydraulic diagram for lifting the side of the wing container.

FIGS. 5, 6 and 7 show hydraulic lifters for the wing side. In this embodiment the hydraulic rams 90 are spaced inward from the front and rear ends, as shown in FIG. 6. Supports 101 welded to the middle parts 98 anchor the cylinders 96. The raising structure is shown in FIGS. 5 and 6. FIG. 7 shows the hydraulic system 110. The strong top 111 and side 113 beams shown in FIG. 6 have extensions 115 shown in FIGS. 1 and 3 that extend into secure twist locks on the base.

Figure 9:
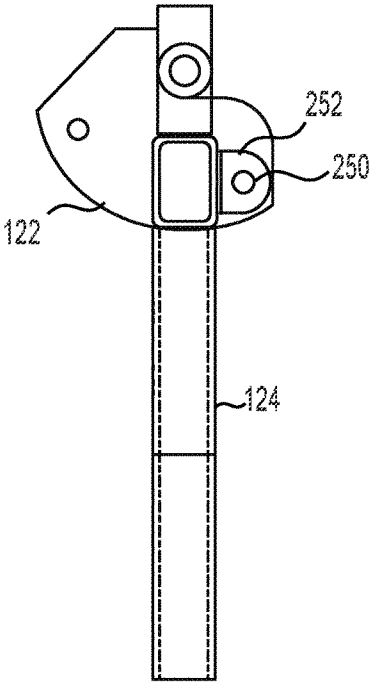
FIG. 9 is a detail of a latch plate locking position shown in FIG. 13.
Figure 8:
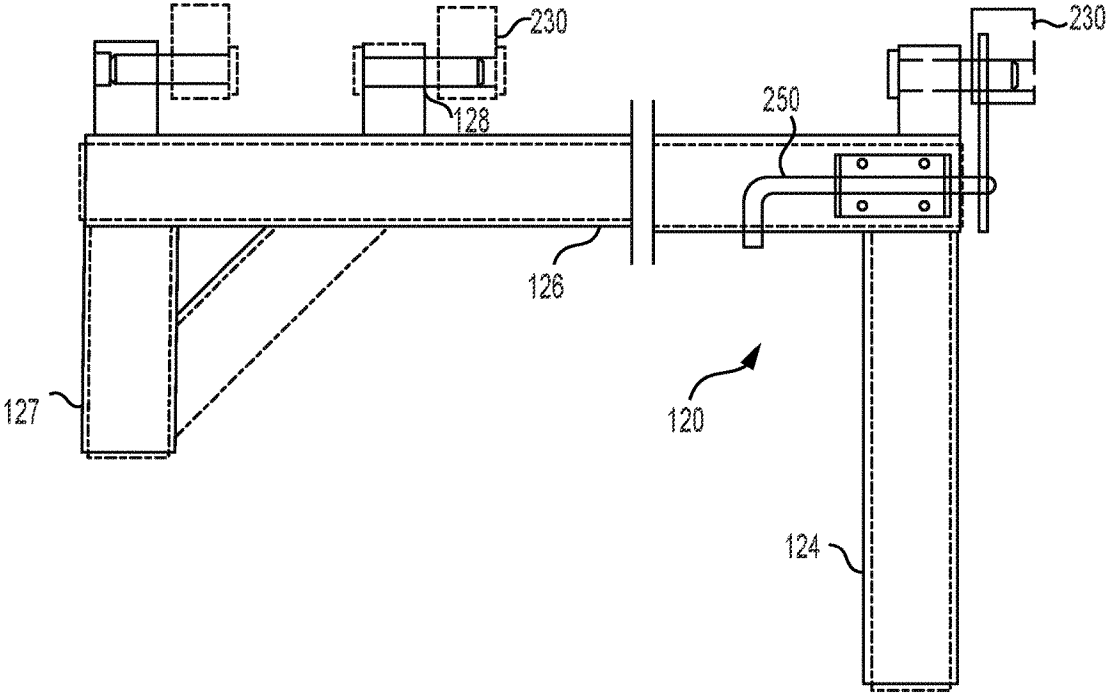
FIG. 8 is a foreshortened square tube detail of the hinging and locking of an open roof support structure.
Figure 10:
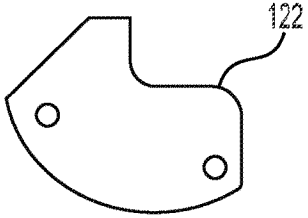
FIG. 10 is a detail of the latch plate shown in FIGS. 13 and 14.

Two sets of square tube locks 120 are shown in FIGS. 8-10.

Two sets of square tube locks 120 are shown in FIG. 8. FIG. 9 shows the positioning of the locking plates 122. Details of the locking plates are shown in FIG. 10.

The square tube locks 120 cooperate with the square tube V-shaped structures 220 connected to the strong side tubes 86 of the movable sidewall 80. The square tube V-shaped structures have sloping tubes 222 welded to the strong side tubes 86 and to the strong square tube 224 at the apex of the V-shaped structure 220, as shown in FIGS. 1-4.

The control lever arm 124 as shown in FIGS. 8 and 9 moves the vertical square tubes 126 with extensions 127 about the axle pivot pins 128 that are mounted inside extensions 230 connected to the strong metal posts 98, as shown in FIGS. 1-4.

Rotation of the vertical square tubes 126 positions blocking truss extensions 240 beneath the square tubes 224 of the V-shaped truss structures 220 to prevent a lowering of the wing sidewall.

Turning the lever arms 124 so that the pins 250 attached to extensions 252 align with the second openings in the locking plates 122. The blocking trus extension 240 are moved to the end walls and lowering the wing sidewall is permitted.

Figure 11:
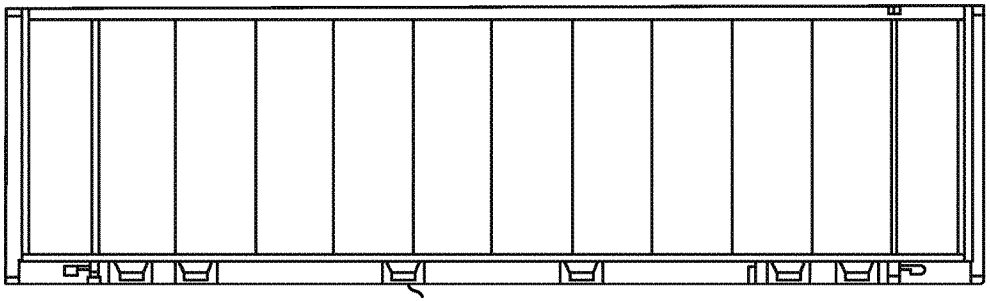
FIG. 11 is a left side elevation of the side wing opening container with the movable side down and locked.
Figure 12:
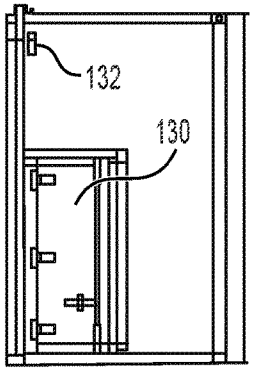
FIG. 12 is a front-end elevation of the container shown in FIG. 11.

Outer claddings as shown in FIG. 11 are attached to the surfaces of the structural parts of the skeleton shown in figure is 11-13. A door 130 and a vent 132 are provided in the front end. A vent 132 and a window 134 are provided in the rear end.

Figure 14:
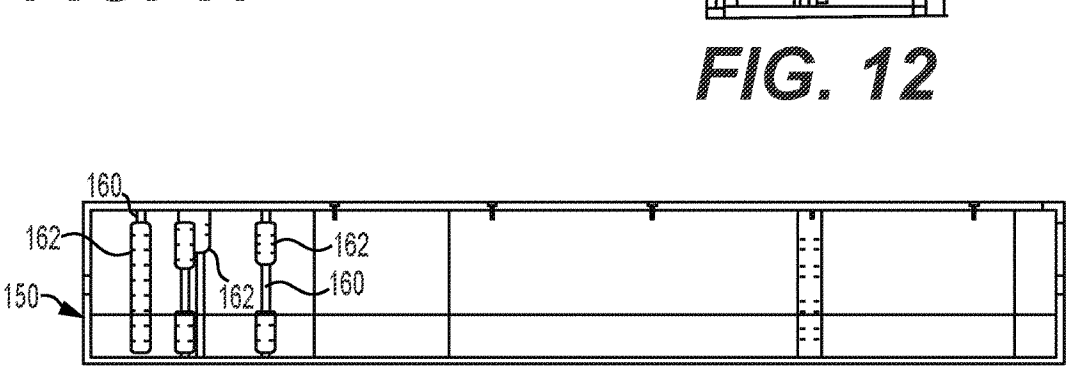
FIG. 14 is an internal plan view of the base of the container.
Figure 15:
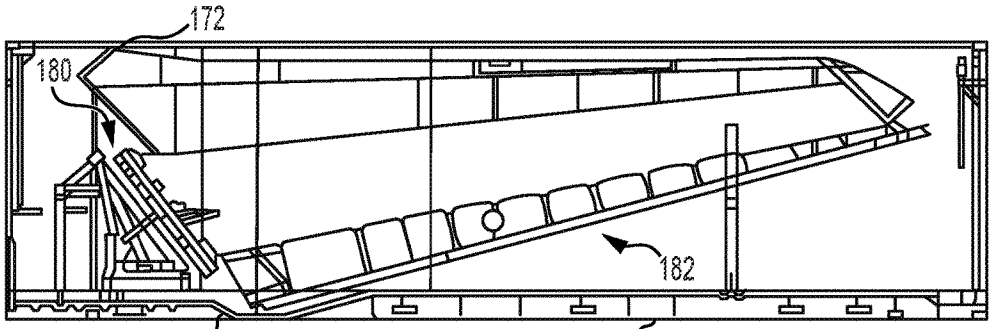
FIG. 15 shows an aircraft wing mounted on wing root anchor in an interior elevation of the wing side opening container.
Figure 13:
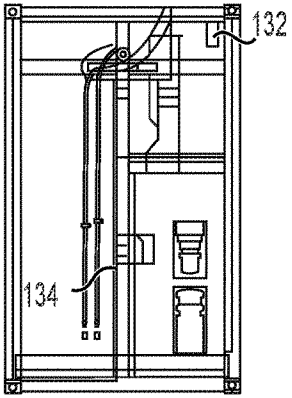
FIG. 13 is a rear end elevation of the container shown in FIG. 11.

FIG. 14 shows the base of the wing side wall opening container, and FIG. 15 shows an aircraft wing held in the intermodal container. The raising of the sidewall and a portion of the roof is useful for loading and unloading the wing.

The base 150 shown in FIG. 14 is configured to support the anchoring structure for a particular product to be transported. Reinforced cross members 160 have been configured with plates 162 for receiving bolts supporting the anchoring structure and with a bolt receiving crossmember 162 for securing product supports.

As shown in FIG. 15, the inside of the reusable top and side wall has been displaced 172. The floor of the base has been modified 174 for properly positioning the anchoring device 180 to hold an aircraft wing 182.

Three pairs of forklift tunnels 190 have been provided for moving the container with the protected road.

While the invention has been described with reference to specific embodiments, materials of construction, modifications and variations of the invention may be constructed without departing from the scope of the invention, which is defined in the following claims.

I claim:

1. Apparatus comprising an intermodal shipping container having a closed-side and an openable side, further comprising:

a base having bottom side rails and bottom end rails connected to ends of the bottom side rails;

corner plates connected to the bottom side rails and the bottom side rails at intersections thereof;

floor cross members connected between the bottom side rails;

fixed end posts extending upward from connections with the corner plates;

top end rails connected to the fixed end posts;

a top closed-side rail connected to the top end rails;

a middle top rail connected to the top end rails;

frames connected to the corner posts, the end rails, the bottom side rail on the closed side, the top end rails, the top middle rail and the top closed-side rail;

end walls, a closed-side wall and a fixed roof portion connected to the frames, the end rails, the closed side rails and the top middle rail;

a movable sidewall having a movable roof portion and a movable side wall portion;

the movable roof portion having roof portion cross members hinged to the top middle rail;

the movable side portion having a top side rail and a bottom rail and side edge supports connected to the top side rail and to the bottom rail.

2. The apparatus of claim 1 further comprising spaced support members connected to the movable side portion parallel to the side edge supports, spaced equally with the movable roof section cross members and connected thereto, and angular truss forming members connected to the spaced support members and to the movable roof section cross members to reinforce and stabilize the movable side wall portion.

3. The apparatus of claim 2 further comprising spaced parallel vertical side supports on the closed-side wall extending from the base bottom side rail to the top closed-side rail, the side supports being spaced with and connected to fixed roof portion cross members, diagonal rigid members extending from connections with intersections of the spaced parallel vertical side supports with the bottom side rail to the middle top rail, at the fixed roof portion cross members, thereby forming trusses for supporting the middle top rail, the closed-side wall and the fixed roof portion.

4. The apparatus of claim 1 further comprising middle posts connected to the bottom end rails and hydraulic rams connected to intersections of the movable top side edges and to tops of the middle posts for raising and lowering the movable side wall and the movable roof portion.

5. The apparatus of claim 1 further comprising V-shaped truss support structures extending downward from sides of the movable side for holding the movable side and roof portion upwards when the movable sidewall is in raised position.

6. The apparatus of claim 5 further comprising movable blocks connected to end wall frame structures for moving to block and support the V-shaped truss support structures when the movable sidewall is in raised position.

* * * * *